US005575744A

United States Patent [19]

Jones et al.

[11] Patent Number: 5,575,744

[45] Date of Patent: Nov. 19, 1996

[54] ABDUCTOR EXERCISE MACHINE

[75] Inventors: Arthur A. Jones, Ocala; Philip Sencil, Anthony, both of Fla.

[73] Assignee: MedX Corporation, Ocala, Fla.

[21] Appl. No.: 440,475

[22] Filed: May 12, 1995

Related U.S. Application Data

[63] Continuation-in-part of Ser. No. 397,938, Mar. 3, 1995, Ser. No. 194,460, Feb. 8, 1994, Pat. No. 5,421,796, and Ser. No. 947,284, Sep. 15, 1992.

[51] Int. Cl.[6] ..... A63B 23/04

[52] U.S. Cl. ..... 482/97; 482/136

[58] Field of Search ..... 482/97–100, 135–138, 482/907

[56] References Cited

U.S. PATENT DOCUMENTS

| | | | |
|---|---|---|---|
| 684,688 | 10/1901 | Herz | 482/97 |
| 4,125,258 | 11/1978 | McArthur | 482/136 X |
| 4,349,194 | 9/1982 | Lambert, Jr. et al. | 482/136 X |
| 4,478,411 | 10/1984 | Baldwin | 482/136 |
| 5,135,452 | 8/1992 | Jones | 482/99 |
| 5,256,125 | 10/1993 | Jones | 482/137 |

FOREIGN PATENT DOCUMENTS

| | | | |
|---|---|---|---|
| 270131 | 6/1988 | European Pat. Off. | 482/137 |

*Primary Examiner*—Richard J. Apley
*Assistant Examiner*—John Mulcahy
*Attorney, Agent, or Firm*—William E. Mouzavires

[57] ABSTRACT

An abductor machine has a pair of movement arms including thigh pads engageable by the user's thighs to move the movement arms outwardly about vertical axes while the user is seated with the thighs located between the thigh pads. The movement arms are connected to a weight stack by a transmission including connecting rods interconnecting the movement arms and a cam, and a cam follower which is connected to an actuating lever which in turn drives the weight stack pin. The lateral position of the thigh pads is adjustable to suit the size of the user's thighs. The thigh pads are also self-adjustable about vertical axes. An adjustable backrest is also provided to change the posture of the user so that the exercise may be concentrated on different portions of the abductor muscles. Once adjusted, the backrest is locked in position.

12 Claims, 3 Drawing Sheets

20
24
27
10a
40
52
51
49
48
50
26
34
54
32
34
36
10
28
60
16
25
29
9
77
72
64
70
14
76
84
74
82

ABDUCTOR EXERCISE MACHINE

This application is a continuation-in-part of the following U.S. applications:

U.S. application, Ser. No. 08/397,938, filed Mar. 3, 1995, entitled METHOD AND APPARATUS FOR EXERCISING ADDUCTOR MUSCLES;

U.S. application, Ser. No. 08/194,460, filed Feb. 8, 1994, now U.S. Pat. No. 5,421,796 entitled TRICEPS EXERCISE MACHINE; and U.S. application, Ser. No. 07/947,284, filed Sep. 15, 1992, entitled EXERCISE MACHINES AND METHODS.

The entire disclosures of each of the above-identified parent applications are incorporated by reference into the subject application as part hereof.

OBJECTS OF THE PRESENT INVENTION

The present invention generally relates to exercise machines and methods and more particularly to a novel and improved machine and method for exercising leg muscles and specifically the gluteus medius muscles otherwise known as the abductor muscles.

An object of the present invention is to provide a novel and improved machine and method for exercising the abductor muscles. Included herein is such a machine and method which can be used to safely exercise the abductor muscles in a highly efficient and effective manner.

A further object of the present invention is to provide a novel and improved machine and method for exercising the abductor muscles and which may be adapted to concentrate the exercise on various portions of the abductor muscles.

A further object of the present invention is to provide a novel and improved machine for exercising the abductor muscles and which incorporates an improved transmission for transmitting forces between a movement arm and a resistance such as a weight stack.

A further object of the present invention is to provide a novel and improved machine for exercising the abductor muscles and which will provide effective and efficient exercise over long periods of repeated and rugged use.

SUMMARY OF THE PREFERRED EMBODIMENT OF THE INVENTION

In the preferred embodiment of the invention, an abductor exercise machine includes a generally horizontal seat and an adjustable backrest which may be placed into different angles in order to concentrate the exercise on various portions of the abductor muscles. The preferred machine further includes a pair of movement arms having opposed thigh pads for engaging the outer portions of the thighs above the knees so that when the exerciser spreads his thighs against the thigh pads, the movement arms will be rotated about vertical axes. The position of the pads may be adjusted laterally inwardly or outwardly relative to the user's thighs to suit the particular size of the exerciser. When the pads are moved laterally outwardly away from each other during an exercise, a linkage connected to the movement arms rotates a cam which in turn drives a cam follower which is connected to a lever. The latter is connected to a vertical stack pin and a resistance weight stack for raising the stack pin and one or more weights on the pin. When the exerciser relieves pressure oil the pads, the resistance weight returns the movement arm to the starting positions.

DRAWINGS

Other objects of the present invention will become apparent from the following more detailed description taken in conjunction with the drawings in which.

DETAILED DESCRIPTION

Figure 3:
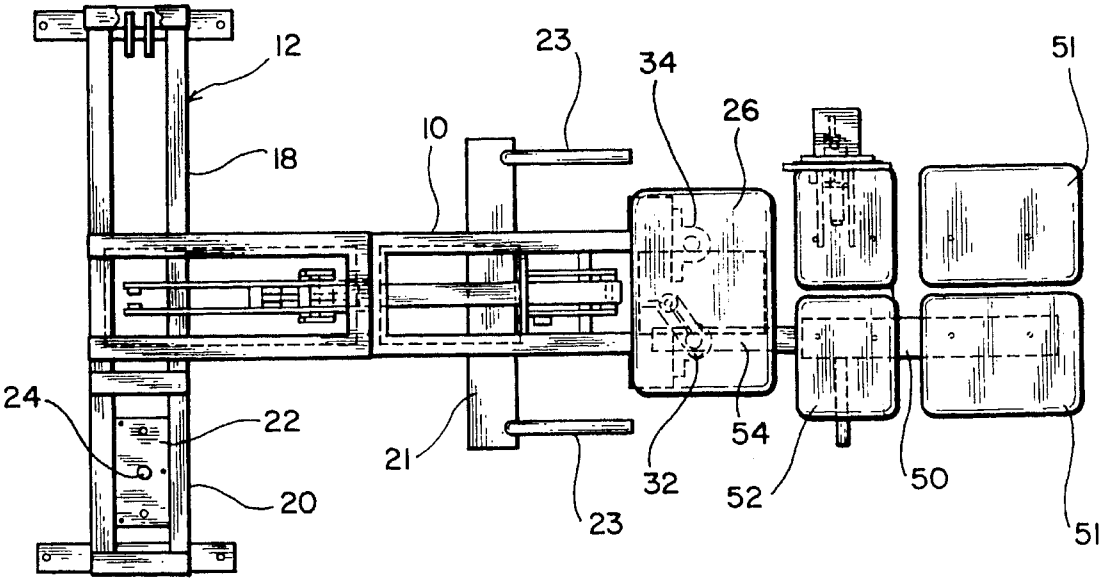
FIG. 3 is a plan view of the machine of FIG. 1.
Figure 2:
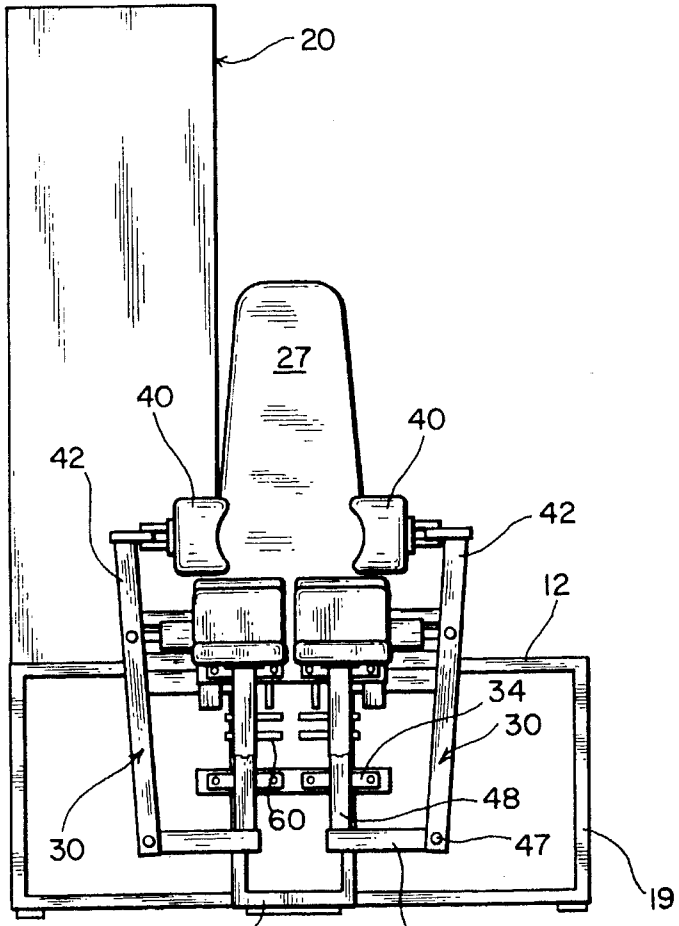
FIG. 2 is a front elevation 1 view of the machine of FIG. 1.

Referring now to the drawings in detail there is shown for illustrative purposes only, an abductor exercise machine including a front frame having in one specific embodiment, a generally rectangular construction including horizontal and vertical frame members 14 and 16 respectively formed from any suitable sturdy material such as steel or aluminum alloy steel. Front frame 10 extends perpendicular to a rear frame generally designated 12 having elongated rectangular construction including horizontal and vertical frame members 18 and 19 as shown in FIGS. 2 and 3. At the left hand end of rear frame 12 as shown in FIG. 2 is a weight stack frame generally designated 20 including upper and lower groups of weights 22 mounted on a vertical weight stack pin 24 to be selectively connected to the pin 24 for movement with the pin. In the preferred embodiment, the weight stack is a compound weight stack having upper and lower independent groups of weights which may be connected to the weight stack pin 24 independently of each other so that a relatively great variety of different weights can be selected as resistance to the exercise to be performed by the user of the machine. For a more detailed description of the compound weight stack employed in connection with the present invention, reference may be had to U.S. Pat. No. 4,834,365 of Arthur A. Jones entitled COMPOUND WEIGHT SYSTEM issued May 30, 1989 whose entire disclosure is incorporated by reference into the subject application as part hereof.

Figure 1:
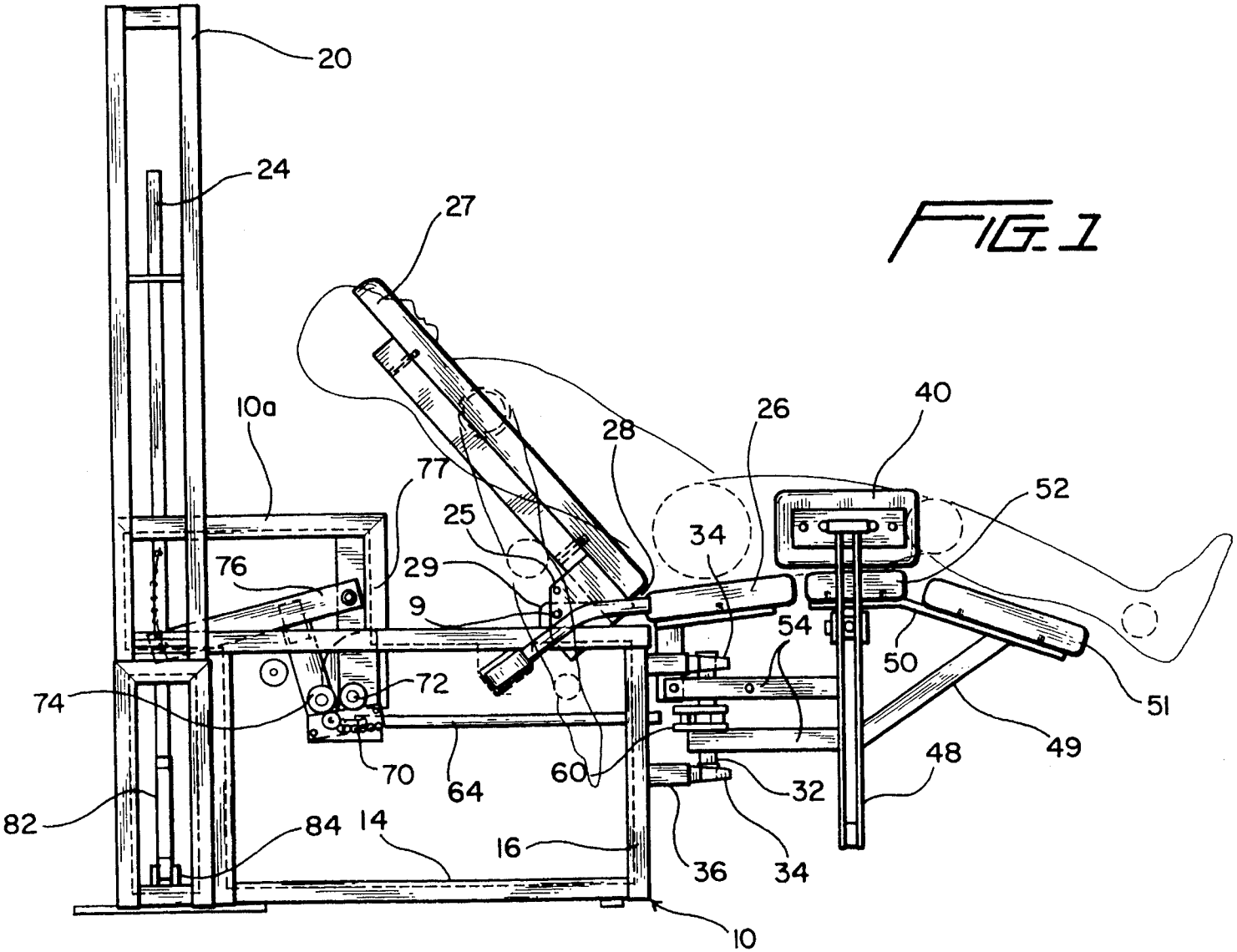
FIG. 1 is a side elevational view of an abductor exercise machine with certain parts removed.

The machine includes a generally horizontal seat 26 having an underlying mounting plate fixed to the front frame 10 for receiving the exerciser as shown in FIG. 1. In addition a backrest 27 is mounted for pivotal movement at pivot 28 at the rear of seat 26 to allow the position of the exerciser to be adjusted in order to concentrate the exercise on different portions of the abductor muscles to be exercised. Once adjusted, the backrest 27 is fixed in the adjusted position. In the specific embodiment, the adjustment of the backrest 27 is achieved by means of a bracket shown as a rearwardly extending plate 25 fixed to the backrest frame having a series of spaced apertures for receiving a locking pin which also extends into a bracket 29 fixed to the front frame 10 for receiving the locking pin 9. With the locking pin 9 removed from the apertures in the brackets 25 and 29, the backrest may be adjusted angularly by means of a handle 23 fixed to the backrest by means of a bracket 21 shown as a crossbar in FIG. 3 interconnecting a pair of handles 23 on opposite sides of the seat 26.

Figure 4:
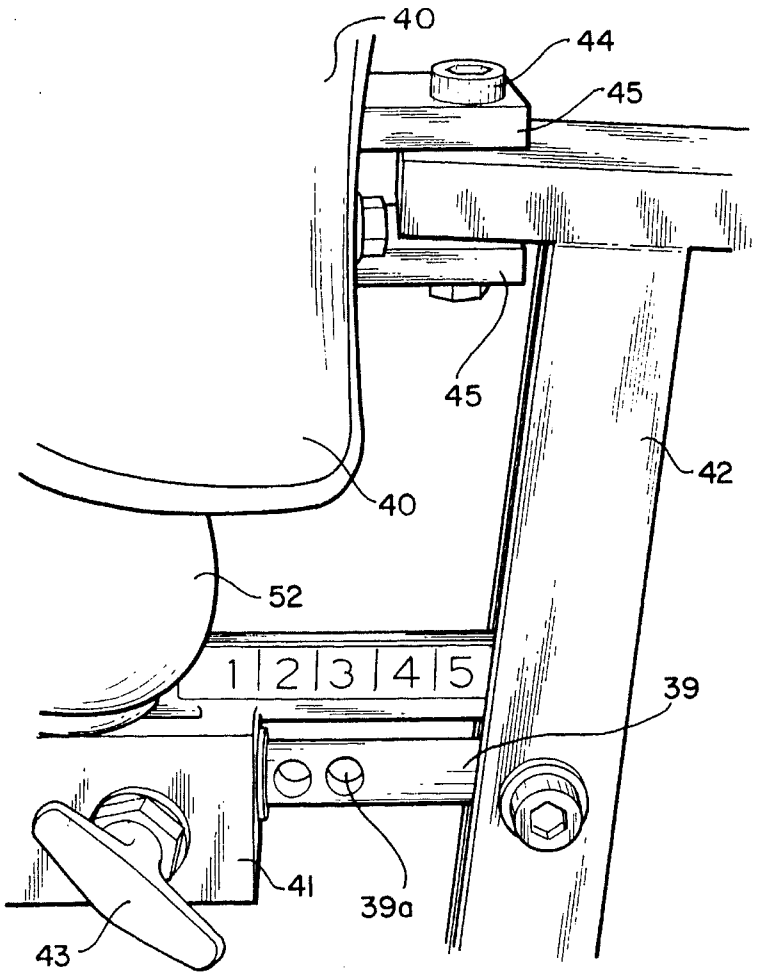
FIG. 4 is a front elevational view of a fragmental portion of the machine showing a thigh pad pivot and a lock mechanism for securing the thigh pad in an adjusted position.

Referring to FIG. 2, exercise of the abductor muscles is performed by spreading the legs from an extended closed position generally shown in FIG. 1, to place pressure against a pair of opposed thigh pads 40 for swinging outwardly a pair of movement arms 30. Pads 40 are mounted on the upper ends of outer vertically extending portions of the movement arms 30 by means of pivot pins 44 extending through brackets 45 fixed to the pads 40 and top pieces of the portions 42 received between the brackets 45 as shown in FIG. 4. It will be seen that the pads 40 are adjustable about the pivot pins 44 during exercise. In addition the lateral position of the pads 40 with respect to the thighs can be adjusted to suit the particular size of the thighs. This is effected by mounting the arm portions 42 for pivotal movement about pivots 47 to the base portions 46 of the movement arm and then providing a releasable lock mechanism for holding the portions 42 in the adjusted position. In the specific embodiment shown, horizotally extending mounting pins 39 are connected to the arm portions 42 to extend inwardly therefrom and be slidably received in receptacles 41 fixed to inner vertical portions 48 of the movement arms at the top thereof. Mounting pins have a series of apertures 39*a* spaced along the length thereof for receiving locking pins 43 which extend through the receptacles 41 and into one of the apertures 39*a* in the mounting pins. The lower horizontal portions 46 of the movement arms are fixed to the inner vertically extending portions 48 of the movement arms.

Figure 5:
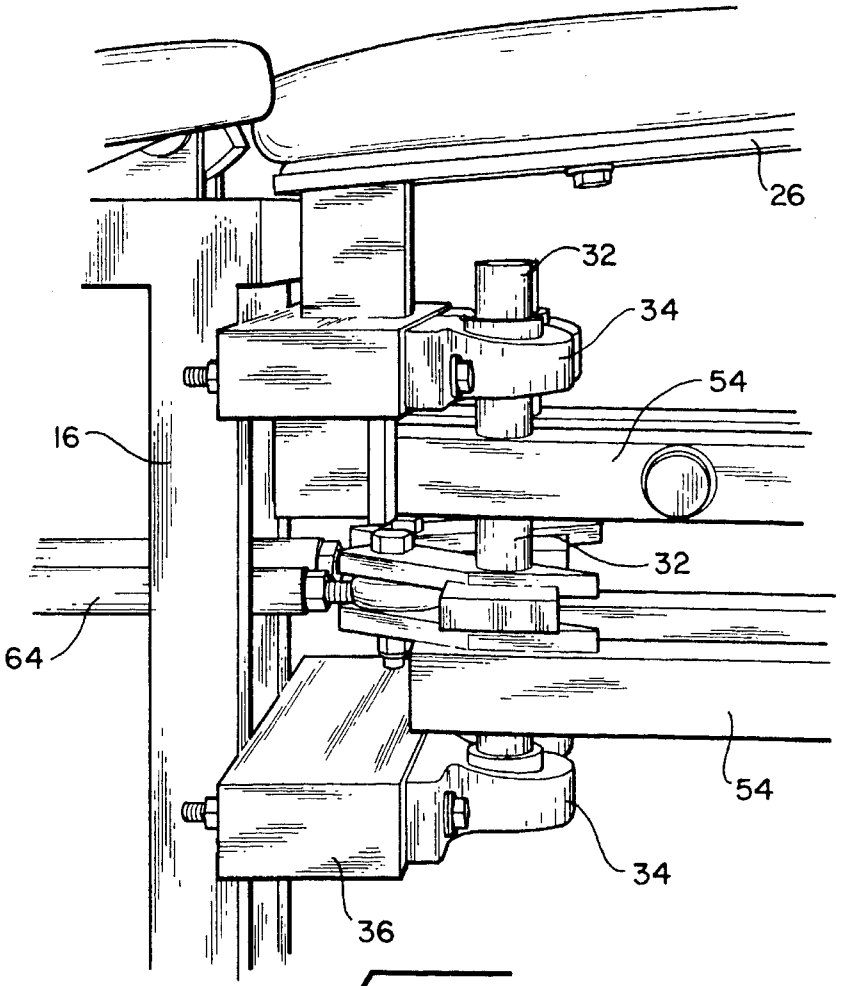
FIG. 5 is a fragmental side elevational view of a portion of the machine showing the pivot shaft of the movement arm.

Referring now to FIGS. 1 and 5, the movement arms 30 are mounted for pivotal movement or rotation about vertical axes shown as being provided by vertical shafts 32 respectively mounted in bearings 34 mounted to the vertical members 16 of front frame 10 by bearing blocks 36. In the specific embodiment shown, the movement arms are provided with a pair of generally parallel mounting members 54 fixed to the inner members 48 of the movement arms and extending horizontally to the shafts 32 about which they are mounted. It will be seen that when the movement arms are moved outwardly by the exerciser's thighs, the arms will pivot about the axes provided by the vertical shafts 32.

The movement arms 30 each further include a pad mounting plate generally designated 50 having a horizontal portion fixed at the upper end of the inner portion 48 and a forwardly downwardly extending angular portion extending forwardly from the horizontal portion and being connected to the portion 48 by means of the strut 49 as best shown in FIG. 1. Pads 52 and 51 for receiving the legs of the exerciser are fixed to the portions of the mounting plate 50 as best shown in FIG. 1. Thigh pads 40 are located above the horizontal pad 52 while the forward pad 51 receives the leg below the knees.

Movement of the movement arms 30 when the thighs are moved outwardly against the pads 40 is transmitted to the weight stack to raise one or more weights 22 connected to the weight stack pin 24 by means of a transmission which includes connecting rods 64 having forward ends connected to the movement arms and rearward ends connected to a cam generally designated 70 for rotating the cam counter clockwise about a horizontal pivot shaft 72 when the movement arms are swung outwardly about shafts 32 by the exerciser. Linkage rods 64 may be connected by any suitable means to the movement arms 30 however in the specific embodiment shown, turn buckles are provided on the forward ends of the rods 64 and received between a pair of ears 60 fixed to at least one of the horizontal mounting members 54 of the movement arms to be rotatable therewith. Pivot pins are received through the turn buckles and ears 60 to complete the connection. The rearward ends of the rods 64 may be provided with turn buckles or other eyes for receiving a pivot pin which pivotally connects the rod 64 to the cam 70. Pivot shaft 72 of the cam is mounted between a pair of dependent plates fixed to the frame 10 in any suitable manner. The cam 70 has an arcuate cam surface for engaging a cam follower 74 for raising a cam follower arm 76 to which the cam 74 is connected; the cam follower arm 76 being pivotally movable about a pivot shaft 77 fixed to an upper frame portion 10*a* of the front frame 10.

Referring now to FIG. 1, the cam follower arm 76 is pivotally connected in the specific embodiment to the top of a connecting element shown as a rod 88 extending vertically downwardly from the arm 76 and pivotally connected to an actuating lever 80 intermediate the ends thereof. One end of the lever 80 is pivotally connected in the shown embodiment to the bottom end of the weight stack pin 24 to raise the pin 24 when raised by the connecting element 88 in response to movement of the movement arms 30 outwardly when the user engages the pads 40. The other end of the actuating lever 80 is pivotally mounted to a fixed support preferably the bottom portion of rear frame 12. In the embodiment shown, this is achieved through a mounting link shown as a generally vertically extending link 82 having its upper end pivotally connected to the actuating lever 80 and its lower end pivotally connected to the rear frame 12 at the mounting brackets 84 shown in FIG. 1.

To summarize use of the machine, the normal position of the movement arms 30 is shown in FIG. 2. In this position the thigh pads 40 extend generally parallel to each other and the mounting members 54 of the movement arms also extend generally parallel to each other in the forward-rearward direction of the machine. While in the machine, the exerciser adjusts the backrest 27 by removing locking pin 9 from the brackets 25 and 29 and pivoting the backrest into the desired position by means of one of the handles 23. The locking pin 9 is then reinserted through the apertures in the brackets 25 and 29. In the preferred embodiment, locking pin 9 is mounted in the bracket 25 through means of a spring so that upon release of the pin 9 the spring will automatically urge the pin through the apertures in the brackets 25 and 29. The angular position of the backrest 27 will letermine which portions of the abductor muscles will be exercised. To initiate the exercise, the user spreads both of his legs outwardly at the same time against the pads 40 causing the movement arms 30 to swing outwardly about the vertical shafts 32 against a resistance provided by one or more of the weights 22 in the weight stack. The pivotal mounting of the thigh pads 40 will also cause them to pivot to conform to the contour of the user's thighs. The laterally outward movement of the movement arms 30 just mentioned, will be transmitted through the linkage rods 64 to the cam 70 to rotate the cam and thereby raise the cam follower arm 76 about its pivot shaft 77. The latter movement will be transmitted to the actuating lever 80 by the connecting element 88 to raise the stack pin 24 and in turn one or more resistance weights on the stack pin. When the exerciser relieves the pressure on the thigh pads 40, the resistance weight will cause the actuating lever 80, cam follower arm 76, cam 70, connecting link 64 and movement arms 30 to return to the original starting position from which the exercise may be repeated as desired. When the exerciser wishes to concentrate on other portions of the abductor muscles, the backrest 26, 27 is adjusted into another position and the exercise repeated as desired.

The exerciser then adjusts the lateral position of the thigh pads 40 by releasing the mounting pins 39 in the receptacles 41 pivoting the outer portions 42 of the movement arms inwardly or outwardly depending on the size of the exerciser's thighs. Once this adjustment is made the locking pins 43 are inserted in one of the apertures 39*a* to secure the movement arm portions 42 in the selected positions. Here again a spring biased locking pin 43 may be employed to facilitate adjustment of the pads 40.

Although one preferred embodiment of the present invention has been shown and described above, other forms and variations of the present invention will become apparent to those skilled in the art, and therefore the present invention is not limited to the specific embodiment shown but rather is indicated by the scope of the appended claims.

What is claimed is:

1. A machine for exercising the abductor muscles comprising in combination, a seat for receiving a user, a backrest mounted for pivotal movement at a rear portion of the seat for adjusting the angular position of the backrest relative to the seat, at least one movement arm mounted for movement about a generally vertical axis between an inner position and an outer position in response to engagement by outer portions of the thigh of the user upon exerting abductor muscles, resistance means opposing movement of the movement arm in one direction, means for adjusting the inner position of the movement arm in accordance with the size of the user's thigh, said movement arm including a thigh pad and a thigh pad mounting portion movable laterally relative to the movement arm to adjust the position of the thigh pad, said thigh pad being mounted on the thigh pad mounting portion, means pivotally mounting the thigh pad for movement about a generally vertical axis relative to the thigh pad mounting portion, means for locking the backrest in selected angular position relative to the seat, and wherein said thigh pad-mounting portion is pivotable laterally to adjust the lateral position of the thigh mounting portion relative to the seat and a user's thigh, and means releasably holding said thigh pad mounting portion in a laterally adjusted position.

2. The machine defined in claim 1 including transmission means interconnecting the movement arm and the resistance means including a cam and cam follower operatively connected between the resistance means and the movement arm to transmit motion from the movement arm to the resistance means.

3. The machine defined in claim 2 wherein said resistance means is a weight stack including a generally vertically extending weight stack pin, and said cam follower is operatively connected to the weight stack pin to move the same.

4. The machine defined in claim 3 wherein said transmission means includes actuating lever connected to the weight stack pin and a cam follower lever interconnecting the actuating lever and the cam follower, said cam follower lever being pivotally mounted to fixed portion of the machine.

5. The machine defined in claim 1 including pivot means located below the seat and pivotally mounting said thigh pad mounting portion for lateral movement relative to the movement arm.

6. The machine defined in claim 5 further including means mounting said thigh pad mounting portion for pivotal movement about said generally vertical axis, a cam, a rigid connecting member interconnecting said cam and said means mounting the thigh pad mounting portion, a cam follower engageable on said cam to be driven thereby, and means including a lever holding the cam follower and pivotally mounted with respect to a fixed portion of the machine for transmitting movement of the cam follower to said resistance means.

7. A machine for exercising leg muscles comprising in combination, a seat for receiving a user, at least one movement arm, means mounting the movement arm for movement about a generally vertical axis between inner and outer positions in response to engagement by the leg of a user, said movement arm including a pad-mounting portion pivotable laterally inwardly and outwardly relative to the seat and the movement arm for adjustment purposes, means releasably holding said pad-mounting portion in laterally adjusted position, resistance means opposing movement of said movement arm in one direction about said generally vertical axis, transmission means interconnecting said resistance means and said pad-mounting portion including a connecting member connected to said pad-mounting portion, a rotatable cam connected to said connecting member, a cam follower engageable with said cam, a lever pivotally mounted with respect to a fixed portion of the machine and holding said cam follower, said lever being connected to the resistance means.

8. The machine defined in claim 7 wherein said pad-mounting portion is mounted for pivotal movement relative to the movement arm at a location below said seat.

9. The machine defined in claim 7 wherein said means releasably holding said pad-mounting portion includes a locking pin extending laterally from said pad-mounting portion, and a receptacle receiving said locking pin.

10. A machine for exercising the abductor muscles comprising in combination, a seat for receiving a user, at least one movement arm, means mounting the movement arm for movement about a generally vertical axis between inner and outer positions in response to engagement by the leg of a user, said movement arm including a pad-mounting portion pivotable laterally inwardly and outwardly relative to the seat and the movement arm for adjustment purposes, means releasably holding said pad-mounting portion in laterally adjusted position, resistance means opposing movement of said movement arm in one direction about said generally vertical axis, transmission means interconnecting said resistance means and said pad-mounting portion including a rotatable, a cam follower engageable on the cam and a lever pivotally mounted with respect to a fixed portion of the machine and holding said cam follower, said lever being connected to the resistance means.

11. The machine defined in claim 10 wherein said means releasably holding said pad-mounting portion includes a locking pin extending laterally from said pad-mounting portion, and a receptacle fixed to the machine and receiving said locking pin.

12. A machine for exercising the abductor muscles comprising in combination, a seat for receiving a user, at least one movement arm, means mounting the movement arm for movement about a generally vertical axis between inner and outer positions in response to engagement by the leg of a user, said movement arm including a pad-mounting portion pivotable laterally inwardly and outwardly relative to the seat for adjustment purposes, means releasably holding said pad-mounting portion in laterally adjusted position, resistance means opposing movement of said movement arm in one direction about said generally vertical axis, and transmission means interconnecting said resistance means and said movement arm to transmit motion between said movement arm and said resistance means.

* * * * *